US011175108B1

(12) United States Patent
Lee et al.

(10) Patent No.: US 11,175,108 B1
(45) Date of Patent: Nov. 16, 2021

(54) MODULAR BOLT CATCH FOR FIREARMS

(71) Applicant: Strike Industries, Inc., Santa Ana, CA (US)

(72) Inventors: Shanyao Lee, Santa Ana, CA (US); Shih-Ting Hung, Taoyuan (TW)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 16/904,264

(22) Filed: Jun. 17, 2020

(51) Int. Cl.
*F41A 17/36* (2006.01)
*F41A 17/42* (2006.01)

(52) U.S. Cl.
CPC ..... *F41A 17/36* (2013.01); *F41A 17/42* (2013.01)

(58) Field of Classification Search
CPC ..... F41A 17/36; F41A 17/42; F41A 35/06; F41A 11/00; F41A 11/02
See application file for complete search history.

(56) References Cited

U.S. PATENT DOCUMENTS

| | | | | |
|---|---|---|---|---|
| 6,722,253 | B2 * | 4/2004 | Johnson | F41A 3/12 42/90 |
| 9,518,792 | B1 * | 12/2016 | Huang | F41A 35/00 |
| 10,030,924 | B1 * | 7/2018 | Smith | F41A 17/36 |
| 10,753,696 | B1 * | 8/2020 | Christopher | F41A 17/36 |
| 2010/0251591 | A1 * | 10/2010 | Burt | F41A 35/06 42/70.01 |
| 2011/0283580 | A1 * | 11/2011 | Esch | F41A 17/42 42/14 |
| 2019/0128627 | A1 * | 5/2019 | Christiansen | F41A 3/70 |
| 2020/0263944 | A1 * | 8/2020 | Harris | F41A 17/36 |

* cited by examiner

*Primary Examiner* — Gabriel J. Klein
(74) *Attorney, Agent, or Firm* — Han IP PLLC; Andy M. Han

(57) ABSTRACT

A device implementable on a firearm includes a main body and a paddle portion. The main body includes a bolt catching portion, a first protrusion, a second protrusion, and a pivot portion connecting the bolt catching portion, the first protrusion and the second protrusion. The paddle portion is detachably attached to the first protrusion and the second protrusion of the main body. The paddle portion includes a first paddle, a second paddle, and a connecting portion connecting the first paddle and the second paddle. The pivot portion is pivotably coupled to the wall to allow the bolt catching portion to pivot between a bolt releasing position and a bolt stopping position. The first paddle is coupled to the first protrusion and the second paddle is coupled to the second protrusion.

20 Claims, 8 Drawing Sheets

MODULAR BOLT CATCH FOR FIREARMS

TECHNICAL FIELD

The present disclosure is generally related to firearm accessories and, more particularly, to a modular bolt catch for firearms.

BACKGROUND

Unless otherwise indicated herein, approaches described in this section are not prior art to the claims listed below and are not admitted as prior art by inclusion in this section.

On certain types of firearms (e.g., firearms based on an AR platform such as AR15-styled or AR10-styled rifles, carbines, pistols and shotguns), a bolt catch (also known as a "bolt stop") is a device used by a user to perform an empty reload by releasing a bolt of the firearm when the bolt is locked to the rear. Thus, when a loaded magazine is inserted in a magazine well of a lower receiver of the firearm, the user can press a paddle of the bolt catch to release the bolt as an ergonomic way to chamber a round of ammunition cartridge during an empty reload.

However, as presently a typical mil-spec bolt catch is made of a monolithic piece, any customization of the bolt catch (e.g., enlargement of the paddle of the bolt catch) would require replacement of the bolt catch itself. The replacement would involve removal of an existing bolt catch and installation of a new bolt catch, and this process may be time consuming and may result in scratching and/or blemishing of one or more parts (e.g., lower receiver) of the firearm caused by unintentional contact by a tool used by the user during the process.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issues, an objective of the present disclosure is to propose an innovative design of a modular bolt catch. It is believed that the proposed design can avoid or otherwise minimize aforementioned issues associated with bolt catches. For instance, once a bolt catch in accordance with the present disclosure is installed on a firearm, customization involving the change of size, style, shape and/or surface texture of the paddle(s) of the bolt catch would not require removal or replacement of the bolt catch entirely. This is because the proposed design allows the paddle(s) of the bolt catch to be customized or otherwise changed without the need of removal or replacement of other components of the bolt catch.

In one aspect, a device implementable on a firearm based on an AR platform (e.g., AR15 platform or AR10 platform) may include a main body and a paddle portion. The main body may include a bolt catching portion, a first protrusion, a second protrusion, and a pivot portion connecting the bolt catching portion, the first protrusion and the second protrusion. The paddle portion may be detachably attached to the first protrusion and the second protrusion of the main body. The paddle portion may include a first paddle, a second paddle, and a connecting portion connecting the first paddle and the second paddle. When the device is implemented on the firearm: (a) the main body may straddle over a wall of a lower receiver of the firearm with the bolt catching portion on an inner side of the wall and with the first protrusion and the second protrusion on an exterior side of the wall, (b) the bolt catching portion may be received in a cavity of the lower receiver and may extend in a direction generally perpendicular to a longitudinal axis of the lower receiver, (c) the pivot portion may be pivotably coupled to the wall to allow the bolt catching portion to pivot between a bolt releasing position and a bolt stopping position, and (d) the first paddle may be coupled to the first protrusion and the second paddle may be coupled to the second protrusion.

In another aspect, a device implementable on a firearm based on an AR platform (e.g., AR15 platform or AR10 platform) may include a modular bolt catch. The modular bolt catch may include a main body and a paddle portion. The main body may include a bolt catching portion, a first protrusion, a second protrusion, and a pivot portion connecting the bolt catching portion, the first protrusion and the second protrusion. The paddle portion may be detachably attached to the first protrusion and the second protrusion of the main body. The paddle portion may include a first paddle, a second paddle, and a connecting portion connecting the first paddle and the second paddle.

In yet another aspect, an apparatus implementable on a firearm based on an AR platform (e.g., AR15 platform or AR10 platform) may include a lower receiver and a device. The lower receiver may have a cavity therein. The device may include a main body, a paddle portion, and a pivot pin. The main body may include a bolt catching portion, a first protrusion, a second protrusion, and a pivot portion connecting the bolt catching portion, the first protrusion and the second protrusion. The paddle portion may be detachably attached to the first protrusion and the second protrusion of the main body. The paddle portion may include a first paddle, a second paddle, and a connecting portion connecting the first paddle and the second paddle. The pivot pin may be configured to pivotably couple the device to the lower receiver.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
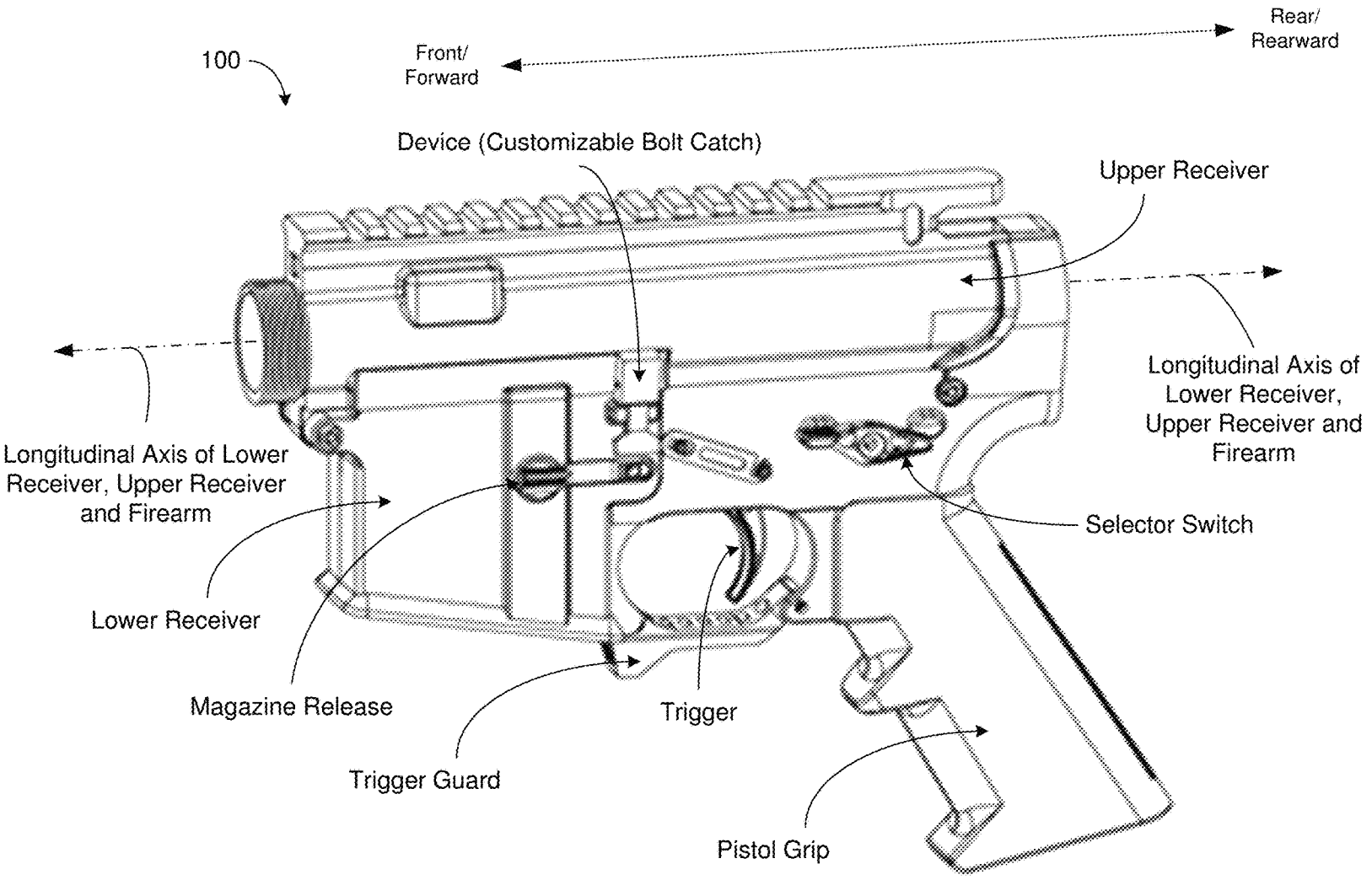
FIG. 1 is a diagram of an apparatus in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

Figure 2:
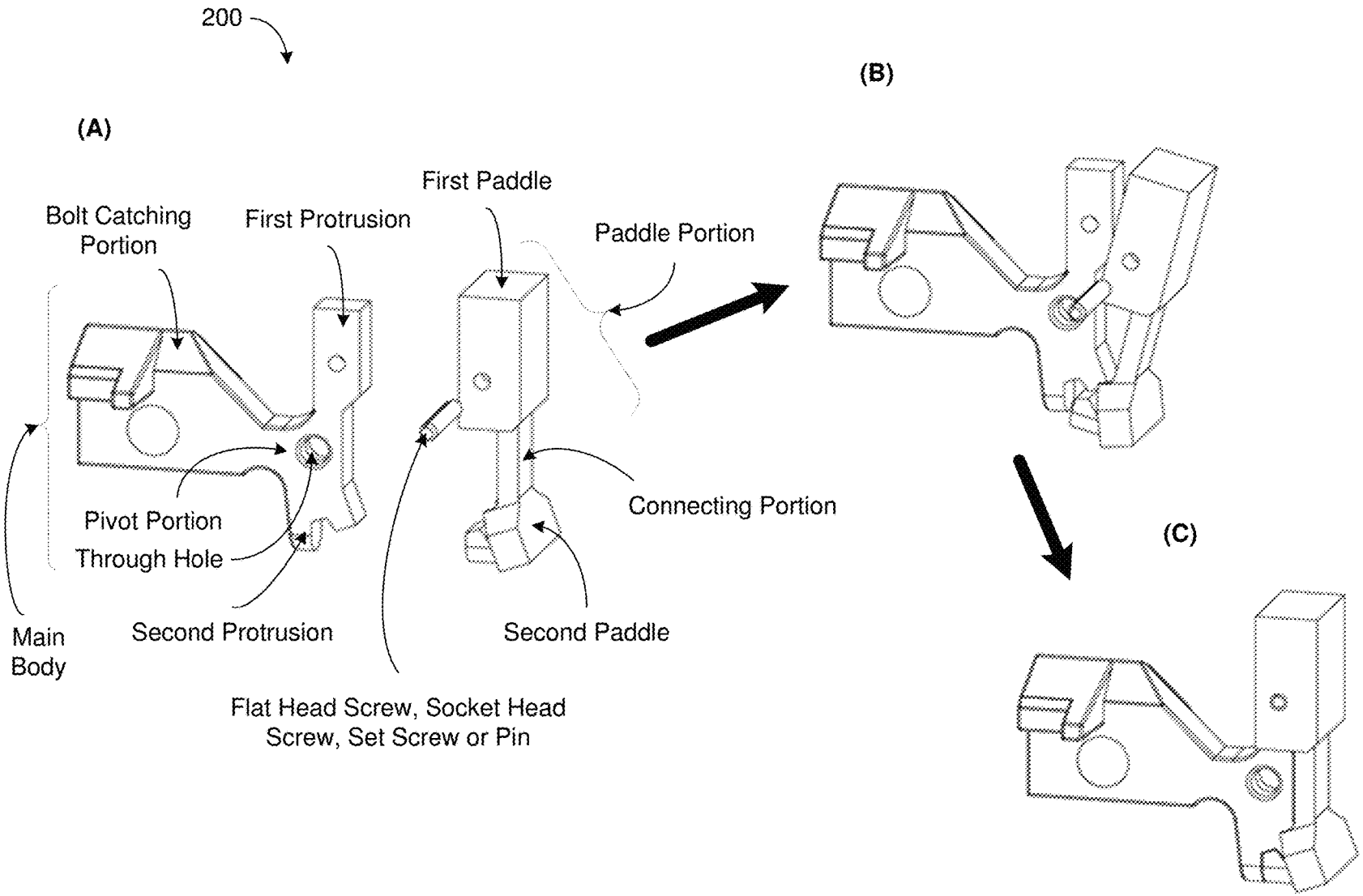
FIG. 2 is a diagram of an example implementation in accordance with an implementation of the present disclosure.
Figure 3:
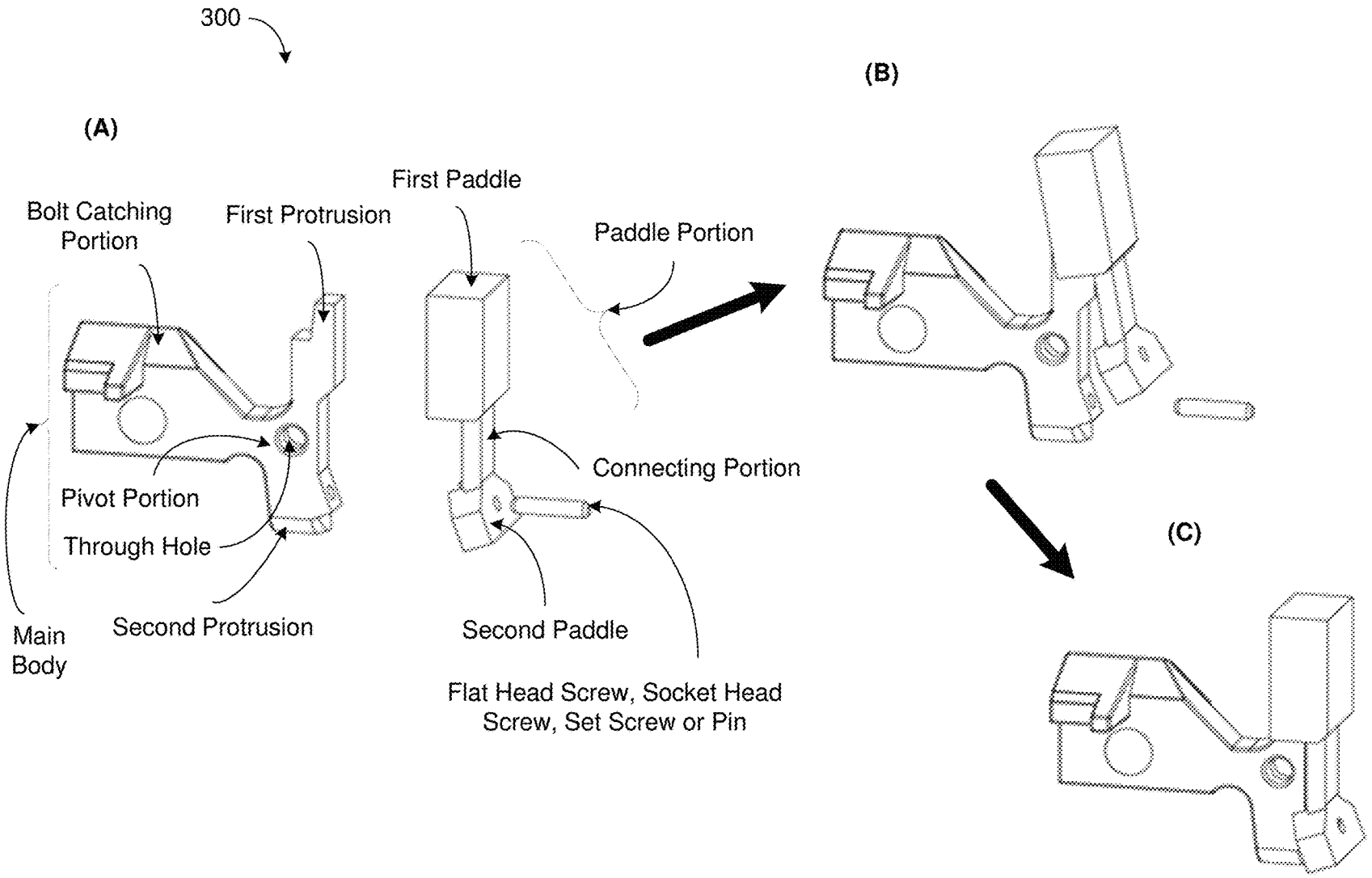
FIG. 3 is a diagram of an example implementation in accordance with an implementation of the present disclosure.
Figure 4:
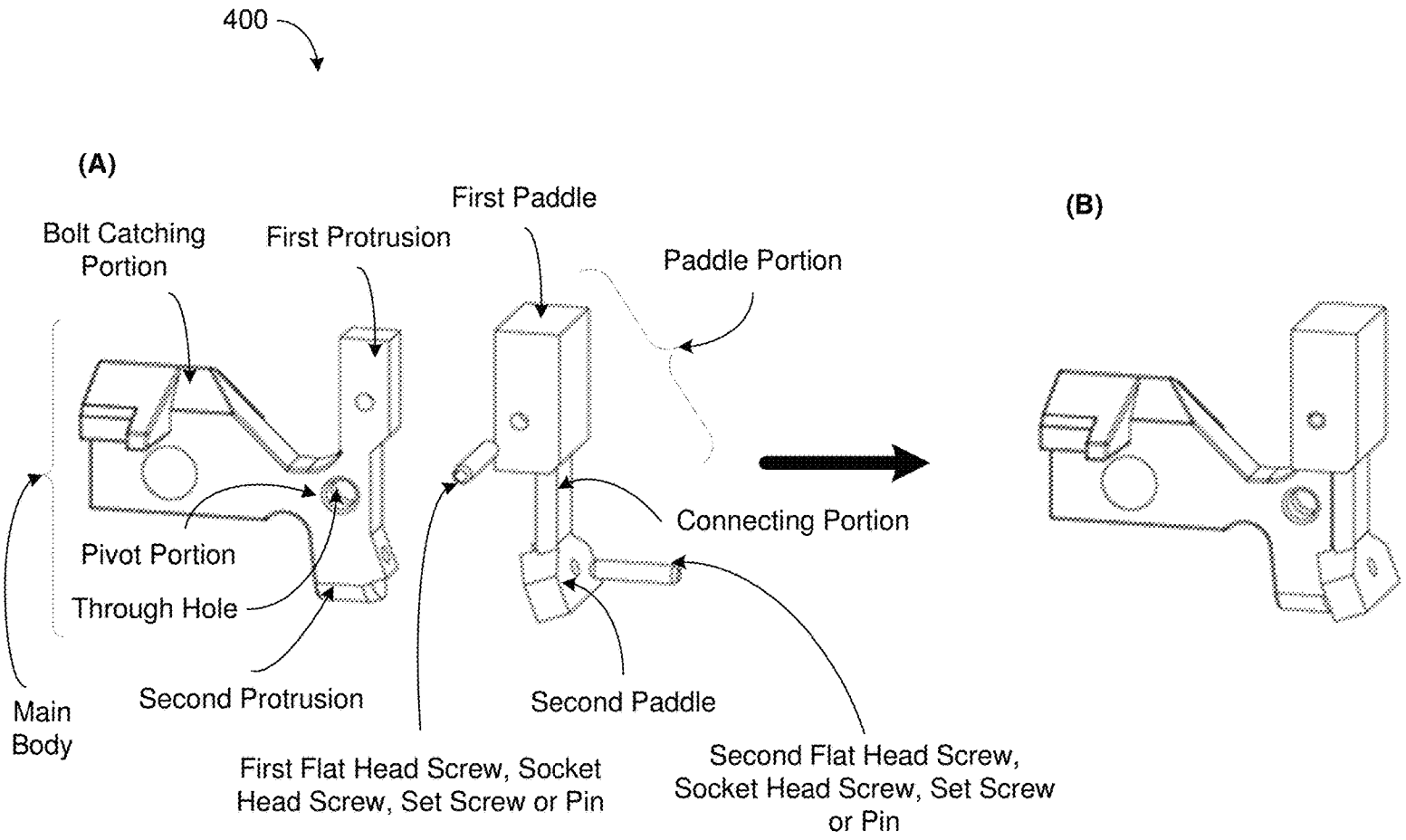
FIG. 4 is a diagram of an example implementation in accordance with an implementation of the present disclosure.
Figure 5:
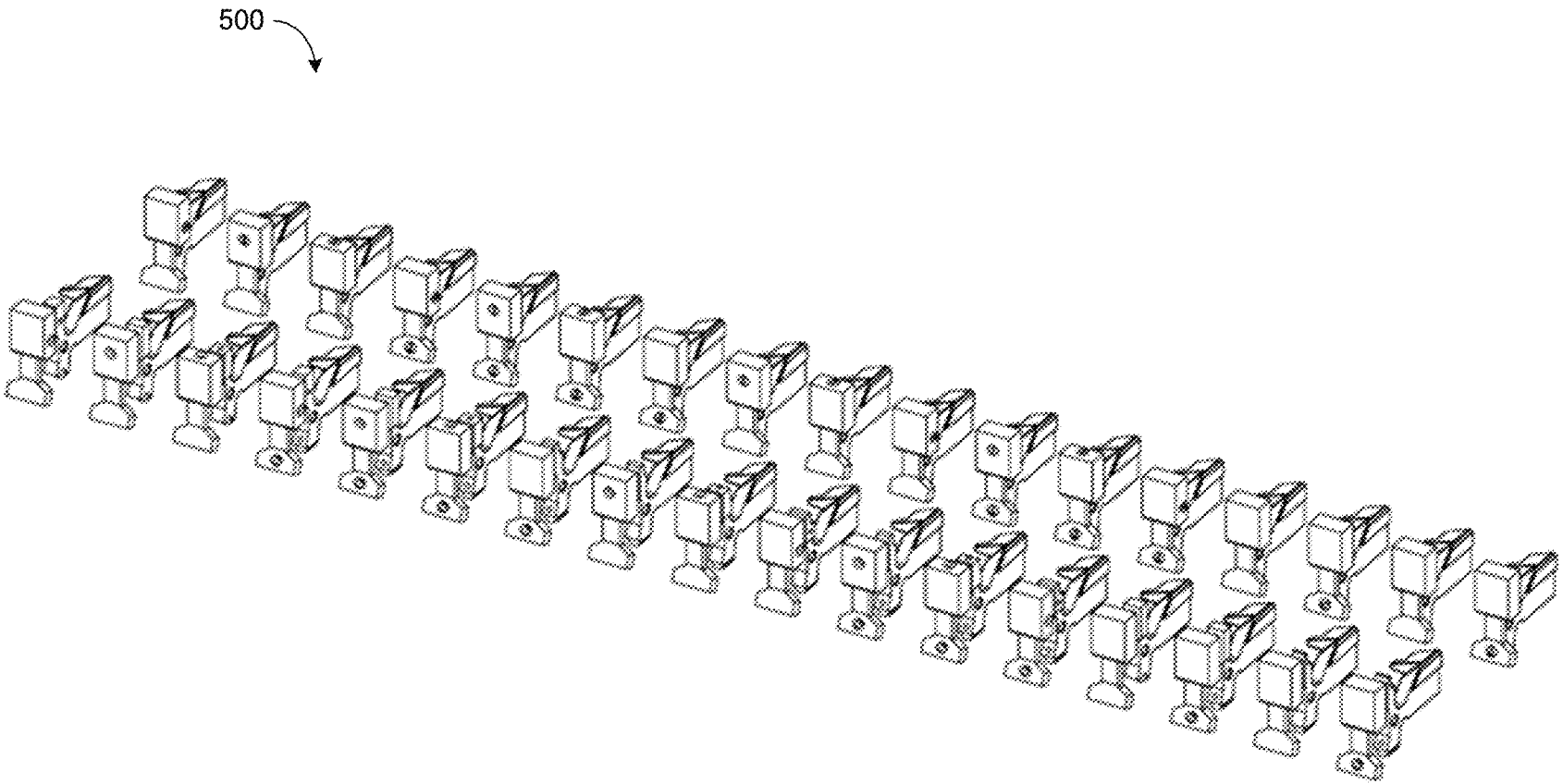
FIG. 5 is a diagram of an example implementation in accordance with an implementation of the present disclosure.
Figure 6:
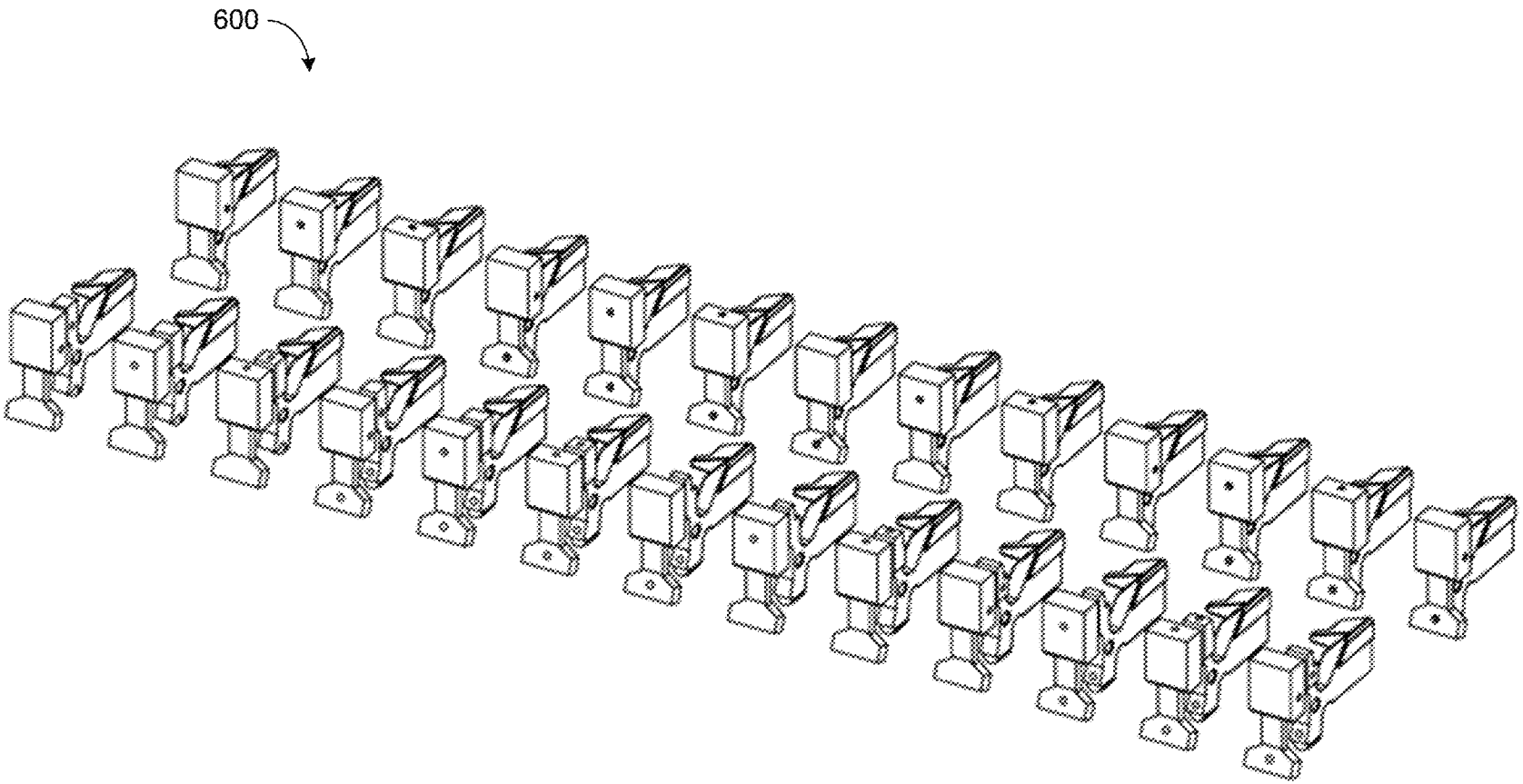
FIG. 6 is a diagram of an example implementation in accordance with an implementation of the present disclosure.
Figure 7:
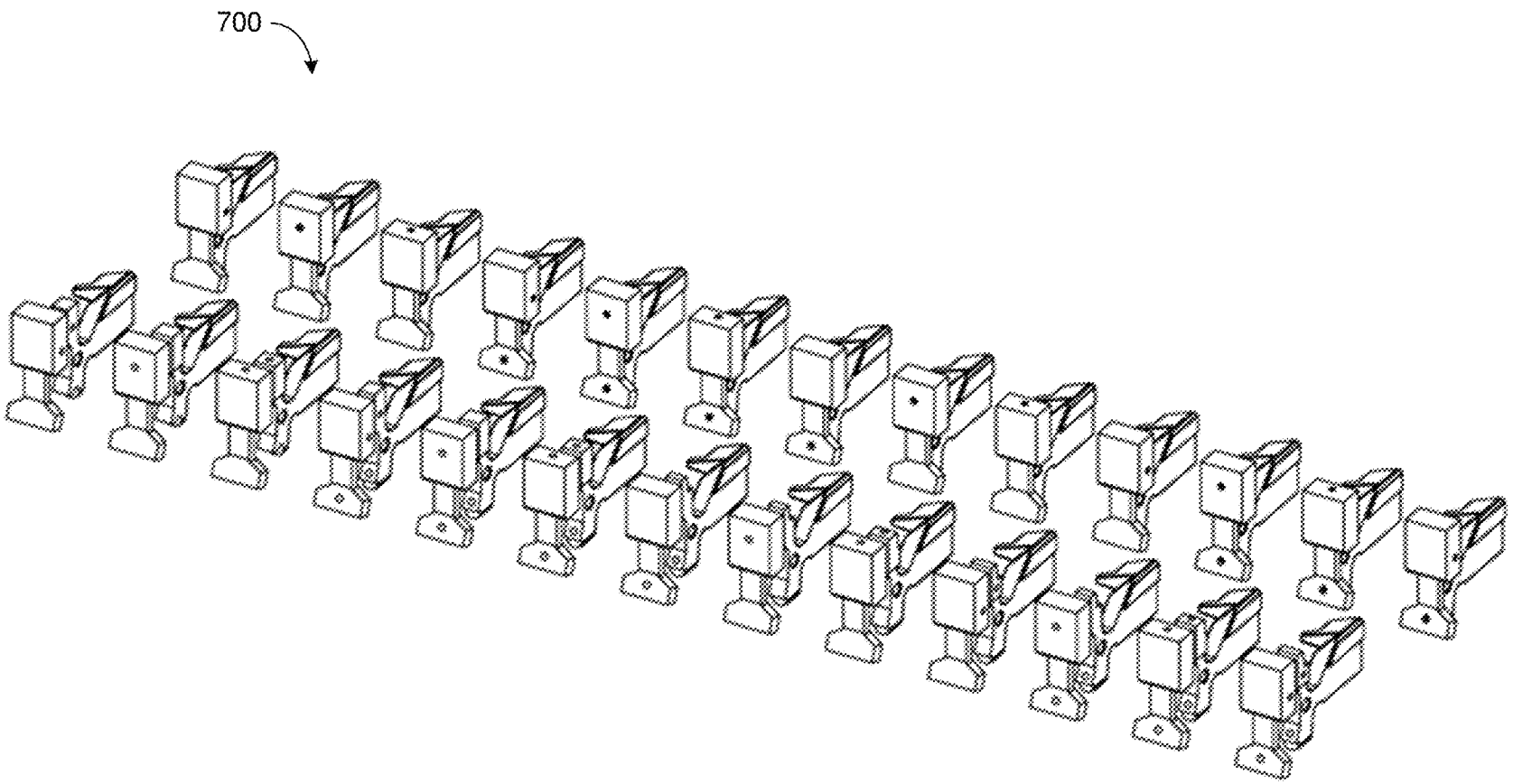
FIG. 7 is a diagram of an example implementation in accordance with an implementation of the present disclosure.
Figure 8:
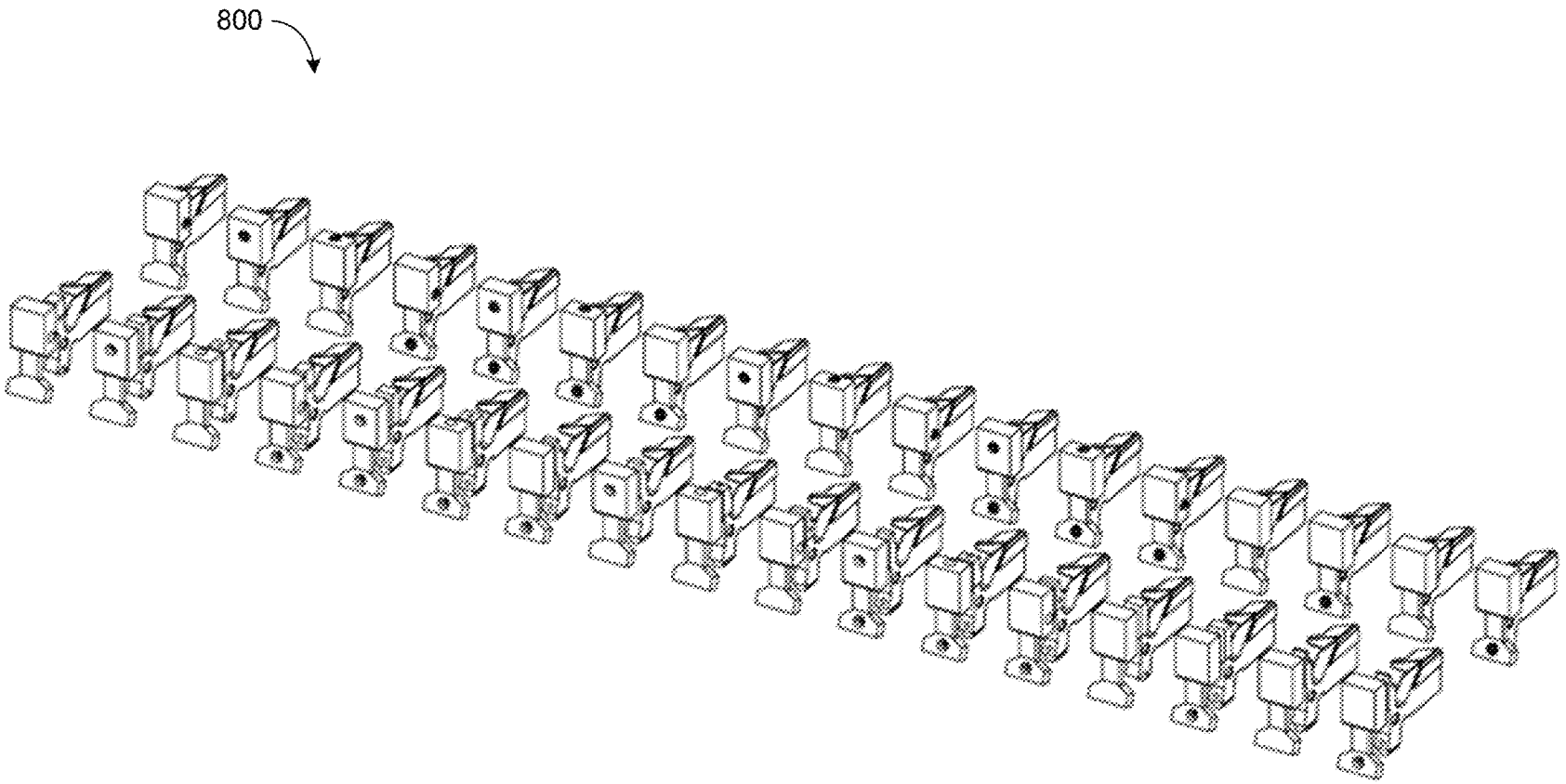
FIG. 8 is a diagram of an example implementation in accordance with an implementation of the present disclosure.

FIG. 1 illustrates an apparatus 100 in accordance with an implementation of the present disclosure. Apparatus 100 may include some or all components of a firearm based on an AR platform (e.g., an AR15-styled or an AR10-styles rifle, carbine, pistol or shotgun). In the interest of brevity and without obscuring the figure, certain components (but not all) of such a firearm are shown in FIG. 1. Referring to FIG. 1, apparatus 100 may include, for example and without limitation, a lower receiver, an upper receiver, a pistol grip, a trigger guard, a trigger and trigger mechanism (not shown), a selector switch, a magazine release, and a device which includes a modular bolt catch in accordance with the present disclosure. Each of the upper receiver, pistol grip, trigger guard, trigger and trigger mechanism, selector switch, magazine release, and the device may be respectively attached to or otherwise installed on the lower receiver. Each of FIG. 2~FIG. 4 illustrates an example implementation of the device as a modular bolt catch in accordance with the present disclosure. Detailed description of the device is provided below with reference to FIG. 2~FIG. 4.

Referring to each of FIG. 2, FIG. 3 and FIG. 4, in each of example implementations 200, 300 and 400, the device as a modular bolt catch may include a main body and a paddle portion. The main body may include a bolt catching portion, a first protrusion, a second protrusion, and a pivot portion connecting the bolt catching portion, the first protrusion and the second protrusion. The pivot portion may include a through hole that allows a pivot pin (not shown) to pivotably secure the device to a wall of the lower receiver. The paddle portion may be detachably attached to the first protrusion and the second protrusion of the main body. The paddle portion may include a first paddle, a second paddle, and a connecting portion connecting the first paddle and the second paddle.

Under a proposed design, when the device is implemented or otherwise installed on the firearm, the main body may straddle over a wall of the lower receiver with the bolt catching portion on an inner side of the wall and with the first protrusion and the second protrusion on an exterior side of the wall. Additionally, the bolt catching portion may be received in a cavity of the lower receiver and may extend in a direction generally perpendicular to a longitudinal axis of the lower receiver. Moreover, the pivot portion may be pivotably coupled to the wall of the lower receiver to allow the bolt catching portion to pivot between a bolt releasing position and a bolt stopping position. Furthermore, the first paddle may be coupled to the first protrusion and the second paddle may be coupled to the second protrusion.

Under the proposed design, when the device is implemented or otherwise installed on the firearm, the first protrusion may extend upward with respect to the lower receiver and the second protrusion may extend downward with respect to the lower receiver. Additionally, when the second paddle is pressed by a user, the bolt catching portion may pivot upward with respect to the lower receiver from the bolt releasing position to the bolt stopping position. Moreover, when the first paddle is pressed by the user, the bolt catching portion may pivot downward with respect to the lower receiver from the bolt stopping position to the bolt releasing position.

In implementation 200, the second paddle may be coupled to the second protrusion by latching to the second protrusion, and the first paddle may be coupled to the first protrusion by a flat head screw, a socket head screw, a set screw or a pin. In implementation 200, the second protrusion may be configured with a serration cut to accommodate a latch on the second paddle to allow mechanical coupling between the second paddle and the second protrusion. The first protrusion may be configured with a through hole or threaded hole to receive the flat head screw, socket head screw, set screw or pin to allow mechanical coupling between the first paddle and the first protrusion.

In implementation 300, the first paddle may be coupled to the first protrusion by latching to the first protrusion, and the second paddle may be coupled to the second protrusion by a flat head screw, a socket head screw, a set screw or a pin. In implementation 300, the first paddle may be configured with an indentation (not shown) to accommodate a latch on the first protrusion to allow mechanical coupling between the first paddle and the first protrusion. The second protrusion may be configured with a through hole or threaded hole to receive the flat head screw, socket head screw, set screw a pin to allow mechanical coupling between the second paddle and the second protrusion.

In implementation 400, the first paddle may be coupled to the first protrusion by a first flat head screw, a first socket head screw, a first set screw or a first pin, and the second paddle may be coupled to the second protrusion by a second flat head screw, a second socket head screw, a second set screw or a second pin. In implementation 400, the first protrusion may be configured with a first through hole or first threaded hole to receive the first flat head screw, first socket head screw, first set screw or first pin to allow mechanical coupling between the first paddle and the first protrusion. Similarly, the second protrusion may be configured with a second through hole or second threaded hole to receive the second flat head screw, second socket head screw, second set screw or second pin to allow mechanical coupling between the second paddle and the second protrusion.

Thus, after the device is installed on a firearm, there is no need for the user to remove or replace the entire device for customization. Rather, the user would merely need to replace an incumbent paddle portion with a new paddle portion which may have a different size, style, shape and/or surface texture than that of the incumbent paddle portion. Advantageously, this would save time and prevent or otherwise minimize the risk of damaging one or more components (e.g., lower receiver) of the firearm due to the customization.

Each of FIG. 5~FIG. 8 illustrates an example implementation of the device as a modular bolt catch in accordance with the present disclosure. Referring to each of FIG. 5, FIG. 6, FIG. 7 and FIG. 8, in each of example implementations 500, 600, 700 and 800, the paddle portion may be coupled to the first protrusion and the second protrusion of the main body in many different ways including latching and/or usage of flat head screw(s), socket head screw(s), set screw(s) and/or pin(s). As shown in each of FIG. 5~FIG. 8, when flat head screw(s), socket head screw(s), set screw(s) and/or pin(s) are used, the location of corresponding through hole(s)/threaded hole(s) where the flat head screw(s), socket head screw(s), set screw(s) and/or pin(s) is/are received may vary on the first protrusion and/or the second protrusion.

It is noteworthy that the dimensions of various components of the proposed design may be adjusted to suit actual implementations. For instance, the overall size may be enlarged for implementation on a firearm of the AR10 platform (e.g., one chambered in 308 Winchester or 7.62×51 mm NATO). Similarly, the overall style may be changed. Likewise, the overall size may be reduced for implementation on a firearm of the AR15 platform (e.g., one chambered in 0.223 Remington or 5.56×54 mm NATO). It is also noteworthy that, with suitable adjustment to one or more components, the modular bolt catch may be made suitable to serve as a bolt charging handle as an alternative or additional use/function. It is further noteworthy that each component of the modular bolt catch may be made of a suitable material (e.g., a suitable metal such as steel, aluminum or alloy) with appropriate mechanical properties such as sufficient strengths and/or hardness to withstand vibrations caused by firing of ammunition cartridges.

It is further noteworthy that term "AR platform" herein refers to firearms based on the AR15 platform and the AR10 platform, as well as any variation and derivative thereof, and include AR15-styled and AR10-styled firearms, including rifles, carbines, pistols and shotguns. A firearm based on an AR platform may be chambered in one of a plethora of calibers. Some of the more popular calibers include such as, for example and without limitation, 0.223 Remington, 5.56×54 mm NATO, 0.224 Valkyrie, 300 AAC Blackout, 7.62×39 mm, 458 SOCOM, 6.5 mm Grendel, 6.8 mm Remington SPC, 308 Winchester and 7.62×51 mm NATO, just to name a few. Accordingly, the proposed design in accordance with the present disclosure may be implemented in any firearm based on the AR platform (whether the AR15 platform or the AR10 platform), as well as any variation and derivative thereof, in any suitable caliber.

Example Implementations

In view of the above, the proposed design of an integrated shell deflector forward assist may be implemented in many ways. For illustrative purposes and without limiting the scope of the present disclosure, a few example implementations of the proposed design are described below.

In one aspect, a device implementable on a firearm based on an AR platform (e.g., AR15 platform or AR10 platform) may include a main body and a paddle portion. The main body may include a bolt catching portion, a first protrusion, a second protrusion, and a pivot portion connecting the bolt catching portion, the first protrusion and the second protrusion. The paddle portion may be detachably attached to the first protrusion and the second protrusion of the main body. The paddle portion may include a first paddle, a second paddle, and a connecting portion connecting the first paddle and the second paddle. When the device is implemented on the firearm: (a) the main body may straddle over a wall of a lower receiver of the firearm with the bolt catching portion on an inner side of the wall and with the first protrusion and the second protrusion on an exterior side of the wall, (b) the bolt catching portion may be received in a cavity of the lower receiver and may extend in a direction generally perpendicular to a longitudinal axis of the lower receiver, (c) the pivot portion may be pivotably coupled to the wall to allow the bolt catching portion to pivot between a bolt releasing position and a bolt stopping position, and (d) the first paddle may be coupled to the first protrusion and the second paddle may be coupled to the second protrusion.

In some implementations, when the device is implemented on the firearm, the first protrusion may extend upward with respect to the lower receiver and the second protrusion may extend downward with respect to the lower receiver. Additionally, when the second paddle is pressed, the bolt catching portion may pivot upward with respect to the lower receiver from the bolt releasing position to the bolt stopping position. Moreover, when the first paddle is pressed, the bolt catching portion may pivot downward with respect to the lower receiver from the bolt stopping position to the bolt releasing position.

In some implementations, either of the first paddle and the second paddle may be coupled to the first protrusion or the second protrusion by a flat head screw.

In some implementations, either of the first paddle and the second paddle may be coupled to the first protrusion or the second protrusion by a socket head screw.

In some implementations, either of the first paddle and the second paddle may be coupled to the first protrusion or the second protrusion by a set screw.

In some implementations, either of the first paddle and the second paddle may be coupled to the first protrusion or the second protrusion by a pin.

In some implementations, either of the first paddle and the second paddle may be coupled to the first protrusion or the second protrusion by latching to the first protrusion or the second protrusion.

In some implementations, the first paddle may be coupled to the first protrusion by latching to the first protrusion, and the second paddle may be coupled to the second protrusion by a flat head screw, a socket head screw, a set screw or a pin. Alternatively, the second paddle may be coupled to the second protrusion by latching to the second protrusion, and the first paddle may be coupled to the first protrusion by a flat head screw, a socket head screw, a set screw or a pin.

In some implementations, the device may further include a pivot pin. The pivot portion of the main body may be configured with a through hole. In such cases, the main body may be pivotably received on the wall of the lower receiver with the pivot pin traversing through the through hole on the pivot portion and receiving portions on the upper receiver.

In another aspect, a device implementable on a firearm based on an AR platform (e.g., AR15 platform or AR10 platform) may include a modular bolt catch. The modular bolt catch may include a main body and a paddle portion. The main body may include a bolt catching portion, a first protrusion, a second protrusion, and a pivot portion connecting the bolt catching portion, the first protrusion and the second protrusion. The paddle portion may be detachably attached to the first protrusion and the second protrusion of the main body. The paddle portion may include a first paddle, a second paddle, and a connecting portion connecting the first paddle and the second paddle.

In some implementations, when the device is installed on the firearm: (a) the main body may straddle over a wall of a lower receiver of the firearm with the bolt catching portion on an inner side of the wall and with the first protrusion and the second protrusion on an exterior side of the wall, (b) the bolt catching portion may be received in a cavity of the lower receiver and may extend in a direction generally perpendicular to a longitudinal axis of the lower receiver, (c) the pivot portion may be pivotably coupled to the wall to allow the bolt catching portion to pivot between a bolt releasing position and a bolt stopping position, and (d) the first paddle may be coupled to the first protrusion and the second paddle is coupled to the second protrusion.

In some implementations, when the device is installed on the firearm, the first protrusion may extend upward with respect to a lower receiver of the firearm and the second protrusion may extend downward with respect to the lower receiver. Additionally, when the second paddle is pressed, the bolt catching portion may pivot upward with respect to the lower receiver from the bolt releasing position to the bolt stopping position. Moreover, when the first paddle is pressed, the bolt catching portion may pivot downward with respect to the lower receiver from the bolt stopping position to the bolt releasing position.

In some implementations, either of the first paddle and the second paddle may be coupled to the first protrusion or the second protrusion by a flat head screw.

In some implementations, either of the first paddle and the second paddle may be coupled to the first protrusion or the second protrusion by a socket head screw.

In some implementations, either of the first paddle and the second paddle may be coupled to the first protrusion or the second protrusion by a set screw.

In some implementations, either of the first paddle and the second paddle may be coupled to the first protrusion or the second protrusion by a pin.

In some implementations, either of the first paddle and the second paddle may be coupled to the first protrusion or the second protrusion by latching to the first protrusion or the second protrusion.

In some implementations, the first paddle may be coupled to the first protrusion by latching to the first protrusion, and the second paddle may be coupled to the second protrusion by a flat head screw, a socket head screw, a set screw or a pin. Alternatively, the second paddle may be coupled to the second protrusion by latching to the second protrusion, and the first paddle may be coupled to the first protrusion by a flat head screw, a socket head screw, a set screw or a pin.

In yet another aspect, an apparatus implementable on a firearm based on an AR platform (e.g., AR15 platform or AR10 platform) may include a lower receiver and a device. The lower receiver may have a cavity therein. The device may include a main body, a paddle portion, and a pivot pin. The main body may include a bolt catching portion, a first protrusion, a second protrusion, and a pivot portion connecting the bolt catching portion, the first protrusion and the second protrusion. The paddle portion may be detachably attached to the first protrusion and the second protrusion of the main body. The paddle portion may include a first paddle, a second paddle, and a connecting portion connecting the first paddle and the second paddle. The pivot pin may be configured to pivotably couple the device to the lower receiver.

In some implementations, when the device is installed on the lower receiver: (a) the main body may straddle over a wall of the lower receiver with the bolt catching portion on an inner side of the wall and with the first protrusion and the second protrusion on an exterior side of the wall, (b) the bolt catching portion may be received in the cavity of the lower receiver and may extend in a direction generally perpendicular to a longitudinal axis of the lower receiver, (c) the pivot portion may be pivotably coupled to the wall to allow the bolt catching portion to pivot between a bolt releasing position and a bolt stopping position, and (d) the first paddle may be coupled to the first protrusion and the second paddle is coupled to the second protrusion.

In some implementations, when the device is installed on the lower receiver, the first protrusion may extend upward with respect to the lower receiver and the second protrusion may extend downward with respect to the lower receiver. Additionally, when the second paddle is pressed, the bolt catching portion may pivot upward with respect to the lower receiver from the bolt releasing position to the bolt stopping position. Moreover, when the first paddle is pressed, the bolt catching portion may pivot downward with respect to the lower receiver from the bolt stopping position to the bolt releasing position.

In some implementations, either of the first paddle and the second paddle may be coupled to the first protrusion or the second protrusion by a flat head screw.

In some implementations, either of the first paddle and the second paddle may be coupled to the first protrusion or the second protrusion by a socket head screw.

In some implementations, either of the first paddle and the second paddle may be coupled to the first protrusion or the second protrusion by a set screw.

In some implementations, either of the first paddle and the second paddle may be coupled to the first protrusion or the second protrusion by a pin.

In some implementations, either of the first paddle and the second paddle may be coupled to the first protrusion or the second protrusion by latching to the first protrusion or the second protrusion.

In some implementations, the first paddle may be coupled to the first protrusion by latching to the first protrusion, and the second paddle may be coupled to the second protrusion by a flat head screw, a socket head screw, a set screw or a pin. Alternatively, the second paddle may be coupled to the second protrusion by latching to the second protrusion, and the first paddle may be coupled to the first protrusion by a flat head screw, a socket head screw, a set screw or a pin.

ADDITIONAL NOTES

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

a main body comprising a bolt catching portion, a first protrusion, a second protrusion, and a pivot portion connecting the bolt catching portion, the first protrusion and the second protrusion; and a paddle portion detachably attached to the first protrusion and the second protrusion of the main body, the paddle portion comprising a first paddle, a second paddle, and a connecting portion connecting the first paddle and the second paddle, wherein, when the device is implemented on the firearm: the main body straddles over a wall of a lower receiver of the firearm with the bolt catching portion on an inner side of the wall and with the first protrusion and the second protrusion on an exterior side of the wall, the bolt catching portion is received in a cavity of the lower receiver and extends in a direction generally perpendicular to a longitudinal axis of the lower receiver, the pivot portion is pivotably coupled to the wall to allow the bolt catching portion to pivot between a bolt releasing position and a bolt stopping position, the first paddle is directly and mechanically secured to a distal end of the first protrusion, the second paddle is directly and mechanically secured to a distal end of the second protrusion, and the first paddle and the second paddle are disposed on a same side of the lower receiver.

2. The device of claim 1, wherein, when the device is implemented on the firearm, the first protrusion extends upward with respect to the lower receiver and the second protrusion extends downward with respect to the lower receiver, wherein, when the second paddle is pressed, the bolt catching portion pivots upward with respect to the lower receiver from the bolt releasing position to the bolt stopping position, and wherein, when the first paddle is pressed, the bolt catching portion pivots downward with respect to the lower receiver from the bolt stopping position to the bolt releasing position.

3. The device of claim 1, wherein either of the first paddle and the second paddle is coupled to the first protrusion or the second protrusion by a flat head screw.

4. The device of claim 1, wherein either of the first paddle and the second paddle is coupled to the first protrusion or the second protrusion by a socket head screw.

5. The device of claim 1, wherein either of the first paddle and the second paddle is coupled to the first protrusion or the second protrusion by a set screw.

6. The device of claim 1, wherein either of the first paddle and the second paddle is coupled to the first protrusion or the second protrusion by a pin.

7. The device of claim 1, wherein either of the first paddle and the second paddle is coupled to the first protrusion or the second protrusion by latching to the first protrusion or the second protrusion.

8. The device of claim 7, wherein the first paddle is coupled to the first protrusion by latching to the first protrusion, and wherein the second paddle is coupled to the second protrusion by a flat head screw, a socket head screw, a set screw or a pin.

9. The device of claim 7, wherein the second paddle is coupled to the second protrusion by latching to the second protrusion, and wherein the first paddle is coupled to the first protrusion by a flat head screw, a socket head screw, a set screw or a pin.

10. The device of claim 1, further comprising:

a pivot pin, wherein the pivot portion of the main body is configured with a through hole, and wherein the main body is pivotably received on the wall of the lower receiver with the pivot pin traversing through the through hole on the pivot portion and receiving portions on the lower receiver.

11. A device implementable on a firearm, comprising:

a modular bolt catch comprising:

a main body comprising a bolt catching portion, a first protrusion, a second protrusion, and a pivot portion connecting the bolt catching portion, the first protrusion and the second protrusion; and a paddle portion detachably attached to the first protrusion and the second protrusion of the main body, the paddle portion comprising a first paddle, a second paddle, and a connecting portion connecting the first paddle and the second paddle, wherein, when the device is implemented on the firearm:

the first paddle is directly and mechanically secured to a distal end of the first protrusion, the second paddle is directly and mechanically secured to a distal end of the second protrusion, and the first paddle and the second paddle are disposed on a same side of a lower receiver of the firearm.

12. The device of claim 11, wherein, when the device is installed on the firearm:

the main body straddles over a wall of the lower receiver of the firearm with the bolt catching portion on an inner side of the wall and with the first protrusion and the second protrusion on an exterior side of the wall, the bolt catching portion is received in a cavity of the lower receiver and extends in a direction generally perpendicular to a longitudinal axis of the lower receiver, and the pivot portion is pivotably coupled to the wall to allow the bolt catching portion to pivot between a bolt releasing position and a bolt stopping position.

13. The device of claim 11, wherein, when the device is installed on the firearm, the first protrusion extends upward with respect to the lower receiver of the firearm and the second protrusion extends downward with respect to the lower receiver, wherein, when the second paddle is pressed, the bolt catching portion pivots upward with respect to the lower receiver from the bolt releasing position to the bolt stopping position, and wherein, when the first paddle is pressed, the bolt catching portion pivots downward with respect to the lower receiver from the bolt stopping position to the bolt releasing position.

14. The device of claim 11, wherein either of the first paddle and the second paddle is coupled to the first protrusion or the second protrusion by a flat head screw.

15. The device of claim 11, wherein either of the first paddle and the second paddle is coupled to the first protrusion or the second protrusion by a socket head screw.

16. The device of claim 11, wherein either of the first paddle and the second paddle is coupled to the first protrusion or the second protrusion by a set screw.

17. The device of claim 11, wherein either of the first paddle and the second paddle is coupled to the first protrusion or the second protrusion by a pin.

18. The device of claim 11, wherein either of the first paddle and the second paddle is coupled to the first protrusion or the second protrusion by latching to the first protrusion or the second protrusion.

19. The device of claim 18, wherein the first paddle is coupled to the first protrusion by latching to the first protrusion, and wherein the second paddle is coupled to the second protrusion by a flat head screw, a socket head screw, a set screw or a pin.

20. The device of claim 18, wherein the second paddle is coupled to the second protrusion by latching to the second protrusion, and wherein the first paddle is coupled to the first protrusion by a flat head screw, a socket head screw, a set screw or a pin.

* * * * *